US007922284B2

(12) United States Patent
Sugahara

(10) Patent No.: US 7,922,284 B2
(45) Date of Patent: Apr. 12, 2011

(54) LIQUID-DROPLET JETTING HEAD AND LIQUID-DROPLET JETTING APPARATUS HAVING THE SAME

(75) Inventor: Hiroto Sugahara, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 823 days.

(21) Appl. No.: 11/894,495

(22) Filed: Aug. 21, 2007

(65) Prior Publication Data

US 2008/0049067 A1 Feb. 28, 2008

(30) Foreign Application Priority Data

Aug. 28, 2006 (JP) ..... 2006-230753

(51) Int. Cl.
*B41J 2/165* (2006.01)
*B41J 2/045* (2006.01)

(52) U.S. Cl. ..... 347/33; 347/71

(58) Field of Classification Search ..... None
See application file for complete search history.

(56) References Cited

U.S. PATENT DOCUMENTS

| | | | | |
|---|---|---|---|---|
| 6,290,341 | B1 | 9/2001 | Furuhata et al. | |
| 6,783,211 | B2 * | 8/2004 | Igaki et al. | 347/68 |
| 6,789,319 | B2 | 9/2004 | Furuhata et al. | |
| 7,153,442 | B2 | 12/2006 | Furuhata et al. | |
| 2004/0119792 | A1 | 6/2004 | Takahashi | |
| 2004/0246291 | A1 * | 12/2004 | Kinpara | 347/20 |

FOREIGN PATENT DOCUMENTS

| | | |
|---|---|---|
| JP | 10119269 | 5/1998 |
| JP | 2003 034026 | 2/2003 |
| JP | 2004148591 | 5/2004 |

* cited by examiner

*Primary Examiner* — Stephen D Meier
*Assistant Examiner* — Alexander C Witkowski
(74) *Attorney, Agent, or Firm* — Frommer Lawrence & Haug LLP

(57) ABSTRACT

An ink-jet head includes a pressure generating block, a nozzle plate having an ink jetting surface, and a manifold block. The manifold block has an inclined surface which inclines toward the ink jetting surface and is continuous to the ink jetting surface at one end thereof.

19 Claims, 10 Drawing Sheets

LIQUID-DROPLET JETTING HEAD AND LIQUID-DROPLET JETTING APPARATUS HAVING THE SAME

CROSS-REFERENCE TO RELATED APPLICATION

The present application claims priority from Japanese Patent Application No. 2006-230753, filed on Aug. 28, 2006, the disclosure of which is incorporated herein by reference in its entirety.

BACKGROUND OF THE INVENTION

1. Field of the Invention

The present invention relates to a liquid-droplet jetting head which jets liquid droplets from nozzles and a liquid-droplet jetting apparatus having the same.

2. Description of the Related Art

An ink-jet head disclosed in Japanese Patent Application Laid-open No. H10-119269 (FIG. 1) corresponding to U.S. Pat. No. 6,290,341 includes a channel forming base member inside which pressure chambers are formed, a nozzle plate which is joined to the channel forming base member and in which nozzles which communicate with the pressure chambers and jet ink in the pressure chambers are formed, and a manifold block which is joined to a face of the nozzle plate on a side opposite to a face joined to the channel forming base member, namely, an ink jetting surface and in which a manifold which retains liquid to be supplied to the pressure chambers is formed, and communication holes for allowing communication of the manifold and the pressure chambers are formed in the nozzle plate. Note that a face of the manifold block which is connected to the ink jetting surface is a face perpendicular to the ink jetting surface. Then, when pressure variation is applied to the ink in the pressure chambers by a piezoelectric actuator arranged on a side opposite to the side on which the nozzle plate of the channel forming base member is joined, ink is jetted from the nozzles.

Here, in the ink-jet head, when there is ink adhering to the vicinity of the nozzles of the ink jetting surface, displacement in jetting direction of ink or the like occurs due to wetting, which may cause decrease in printing quality and/or reliability. Also, there may be dust and/or dirt adhering to the vicinity of the nozzles, and when there is ink or dust adhering, cleaning of the vicinity of the nozzles is required. The liquid-droplet jetting apparatus has a wiper made of rubber, and the ink or dirt adhering to the ink jetting surface is wiped off by the wiper. When the vicinity of the nozzles is wiped excessively by the wiper, durability of the nozzle plate decreases. Accordingly, it is desirable to decrease the number of times of wiping by the wiper. Since the ink-jet head as described in Japanese Patent Application Laid-open No. H10-119269 has the manifold block arranged on the ink jetting surface of the nozzle plate, when ink or dirt adhering to the vicinity of the nozzles is wiped off by the wiper, there occurs a problem such that the wiper is caught by a corner of the manifold block and hence the ink or dirt cannot be wiped off from the ink jetting surface. It is desirable not to depend on the wiper and to keep the ink jetting surface in a state that no ink or the like adheres thereto.

SUMMARY OF THE INVENTION

Accordingly, an object of the present invention is to solve the above-described problems in the conventional art, and to provide a liquid-droplet jetting head which prevents liquid adhering to the ink jetting surface in the vicinity of the nozzles from remaining thereon. Also, another object of the present invention is to provide a liquid-droplet jetting apparatus which prevents ink or dust from remaining on the ink jetting surface. Respective aspects of the present invention will be shown below. However, reference numerals with parentheses attached to respective elements are just for illustrating these elements, and not for limiting the respective elements.

According to a first aspect of the present invention, there is provided a liquid-droplet jetting head which jets a droplet of a liquid, including: a first block (50) having a plurality of pressure chambers (21) and a pressure applying mechanism (40) which applies pressure variation to the liquid in the pressure chambers (21); a nozzle plate (55) which is joined to the first block (50) and in which a plurality of nozzles (59) communicating with the pressure chambers (21) respectively are formed; and a second block (60, 160, 260, 360, 460) which is arranged on a side opposite to the first block (50) with respect to the nozzle plate (55) and in which a manifold (65, 165, 465) is formed, the manifold retaining the liquid to be supplied to each of the pressure chambers (21); wherein the nozzle plate (55) has a plurality of communication holes (57) each of which communicates the manifold (65, 165, 465) and one of the pressure chambers (21), and the second block (60, 160, 260, 360, 460) has an inclined surface which is inclined toward a surface of the nozzle plate (55) and is continuous to the surface of the nozzle plate at one end of the inclined surface.

Here, "a surface of the nozzle plate" means "a surface of the nozzle plate on a side from which liquid is jetted".

According to this structure, the surface of the second block which is continuous to the surface of the nozzle plate is the inclined surface which inclines toward the surface of the nozzle plate. For example, the nozzle plate is provided to oppose or facing a medium onto which the liquid is to be jetted (jetting-objective medium) in a horizontal direction. After the ink is jetted to the jetting-objective medium via the nozzle plate, the ink adheres to the surface of the nozzle plate in some cases. The liquid adhered flows and moves downward along the inclined surface of the second block due to the weight of the liquid itself (gravity) and separates from the surface of the nozzle plate, namely a nozzle. As a result, it is possible to prevent ink from remaining in the vicinity of the nozzle of the nozzle plate. Also, dust adhering to the nozzle plate moves and flows with the ink and separates from the nozzle plate. Accordingly, the ink jetting surface in the vicinity of the nozzle can be kept clean.

In the liquid-droplet jetting head according to the present invention, the inclined surface may include a transporting structure which transports liquid adhering to the surface of the nozzle plate (55) in an away direction separating away from the nozzles (59). According to this structure, liquid can be transported in the away direction separating away from the nozzles by the transporting structure.

In the liquid-droplet jetting head according to the present invention, the transporting structure may be a groove (166) extending from the one end of the inclined surface in the away direction away from the nozzles (59). The groove as the transporting structure is extended so as to separate liquid from the nozzles. According to this structure, when liquid adhering to the surface of the nozzle plate contacts one end of the groove, the liquid is sucked into the groove by capillary force and is transported securely in the direction separating from the nozzles. Also, the liquid sucked into the groove is retained in the groove by capillary force. Therefore, it is possible to prevent staining or dirtying of the jetting-objective medium and/or the like by dripping of the liquid. Further, when the jetting-objective medium is arranged to oppose or face the surface of the nozzle plate, it is difficult for the jetting-objective medium to contact the liquid retained in the groove formed in the inclined surface, and thus it is possible to prevent staining of the jetting-objective medium. In addition, as compared to a case in which the groove is formed in parallel to the surface of the nozzle plate, the extending length of the groove can be made long. Thus, a larger amount of liquid can be retained in the groove. For example, in the case of a serial-type liquid-droplet jetting head, wind is generated in the vicinity of the liquid-droplet jetting head. For example, since the nozzle plate is provided to oppose the jetting-objective medium in the horizontal direction, the liquid can be transported more easily due to the wind in the direction separating from the nozzles along the groove formed in the inclined surface.

In the liquid-droplet jetting head according to the present invention, the transporting structure may be a transport surface (266) having, at the one end of the inclined surface, a liquid repellency not more than a liquid repellency of the surface of the nozzle plate (55); and the liquid repellency of the transport surface may be decreased in the away direction from the one end toward the other end of the inclined surface. According to this structure, when liquid adhering to the surface of the nozzle plate contacts one end of the transport surface, the liquid is transported in the direction separating away from the nozzles so as to proceed to the area having a lower liquid repellency.

In the liquid-droplet jetting head according to the present invention, the transporting structure may have a first area (366) having a liquid repellency not more than a liquid repellency of the surface of the nozzle plate (55) and a second area (367) having a liquid repellency lower than the liquid repellency of the first area (366); and the first and second areas (366, 367) may be patterned to move the liquid adhering to the surface of the nozzle plate (55) in the away direction from the one end to the other end. According to this structure, since the transporting structure is constituted of two types of areas having different liquid repellencies from each other, the transporting structure can be formed by relatively simple steps such as, for example, forming first a liquid-repellent film having a liquid repellency and corresponding to the first area on a surface having a liquid repellency and corresponding to the second area, and thereafter removing the liquid-repellent film formed on a position corresponding to the second area.

In the liquid-droplet jetting head according to the present invention, the first and second areas (366, 367) both may extend in the away direction from the one end to the other end, the first area (366) may have a width which is decreased from a side of the one end toward a side of the other end, and the second area (367) may have a width which is increased from the side of the one end toward the side of the other end. According to this structure, when liquid adhering to the surface of the nozzle plate contacts a region in which the first and second areas are patterned, the liquid wets the second area and spreads in the second area having a lower liquid repellency. At this time, the second area has a width which is decreased at the one end continuous to the surface of the nozzle plate, and hence the liquid adhering to the surface of the nozzle plate is sucked into the second area by capillary force. Therefore, it is possible to securely transport the liquid in the direction separating away from the nozzles. Also, since the second area has a width which is increased toward the other end, when an amount of liquid sucked into the second area is relatively large, the liquid wets the second area and spread in the second area without dripping.

In the liquid-droplet jetting head according to the present invention, it is preferable that the side of the other end of the first area (366) is a pointed end, and the side of the one end of the second area (367) is a pointed end. According to this structure, the surface of a liquid-droplet adhering to the surface of the nozzle plate breaks on the pointed end of the second area, and hence can wet the second area and spread in the second area smoothly.

In the liquid-droplet jetting head according to the present invention, it is preferable that the second block (60, 160, 260, 360, 460) is produced by injection molding. According to this structure, the second block can be produced by a fewer number of processing steps as compared to the case of producing by joining a plurality of members with each other, or the like. Also, when a groove is formed in the surface of the second block, an etching step or the like for forming the groove is not needed, and the groove can be formed integrally at the time of injection molding. Therefore, the groove can be formed easily.

In the liquid-droplet jetting head according to the present invention, the second block (60, 160, 260, 360, 460) may be formed of resin. According to this structure, as compared to the case of being formed of metal, the second block can be produced at low cost. By way of example, in the case where the block having the pressure chambers is produced by stacking a plurality of metal plates, when the pressure chambers and the manifold are formed in the same block so as to overlap in a stacking direction, it is needed to stack a large number of metal plates, and thus the cost thereof increase (especially for forming a manifold having a large volume, the number of stacked metal plates increases further). However, in the present invention, since the manifold is formed in a member which is separate from the block having the pressure chambers and is formed of resin, the number of stacked metal plates in the block having the pressure chambers can be reduced, and the cost of the entire liquid-droplet jetting head can be reduced.

In the liquid-droplet jetting head according to the present invention, the inclined surface may be formed so that a distance from the surface of the nozzle plate is increased at positions separated away further from in a predetermined direction in which the liquid-droplet jetting head is moved. According to this structure, the liquid adhering to the surface of the nozzle plate flows and moves in the direction separating away from the nozzles on the inclined surface, and thus the liquid is prevented from remaining on the surface of the nozzle plate of the liquid-droplet jetting head. Therefore, the surface of the nozzle plate can be kept clean.

In the liquid-droplet jetting head according to the present invention, the inclined surface may have a planar shape with respect to the surface of the nozzle plate.

In the liquid-droplet jetting head according to the present invention, the inclined surface may include a first inclined surface and a second inclined surface. According to this structure, contact resistance between the wiper and the inclined surface is decreased, and thereby the operating life of the wiper can be longer.

In the liquid-droplet jetting head according to the present invention, one end of the first inclined surface may be continuous to the surface of the nozzle plate and the other end of the first inclined surface may be connected to one end of the second inclined surface, and the other end of the second inclined surface may be continuous to the surface of the nozzle plate. According to this structure, a liquid-droplet, dirt, and/or dust flow and move in a direction separating from the nozzles by weight of themselves.

In the liquid-droplet jetting head according to the present invention, the inclined surface may be provided on the surface of the nozzle plate as a pair of inclined surfaces arranged on both sides of the nozzles. According to this structure, the two inclined surfaces can allow a liquid-droplet, dirt, and/or dust to flow and move in a direction separating from the nozzles by weight of themselves.

The liquid-droplet jetting head according to the present invention may be an ink-jet head.

According to a second aspect of the present invention, there is provided a liquid-droplet jetting apparatus which jets a droplet of a liquid, including:

a liquid-droplet jetting head including a first block (50) having a plurality of pressure chambers (21) and a pressure applying mechanism (40) which applies pressure variation to the liquid in the pressure chambers (21); a nozzle plate (55) which is joined to the first block (50), and in which a plurality of nozzles (59) communicating with the pressure chambers (21) respectively are formed; and a second block (60, 160, 260, 360, 460) which is arranged on a side opposite to the first block (50) with respect to the nozzle plate (55), in which a manifold (65, 165, 465) is formed, the manifold retaining the liquid to be supplied to each of the pressure chambers (21), and which has an inclined surface inclining toward a surface of the nozzle plate (55) and being continuous to the surface of the nozzle plate (55) at one end of the inclined surface, the nozzle plate having a plurality of communication holes (57) each of which communicates the manifold (65, 165, 465) and one of the pressure chambers (21);

a moving section (10) which reciprocates the liquid-droplet jetting head in a predetermined direction;

a medium-transporting section (70) which transports a jetting-objective medium (90), on which the liquid droplet jetted from the liquid-droplet jetting head is to be landed, in an orthogonal direction orthogonal to the predetermined direction; and a wiper (80) which wipes the nozzles (59);

wherein the nozzles (59) form a nozzle row arranged in the orthogonal direction, and the inclined surface is located at least on one side of the nozzle row with respect to the predetermined direction.

According to this structure, when the surface of the nozzle plate is wiped in one direction, the wiper can move smoothly between the surface of the nozzle plate and the inclined surface of the second block without being caught by the second block. Therefore, liquid adhering to the surface of the nozzle plate can be wiped off by the wiper, and also the vicinity of the nozzles can be kept clean even when the number of times of wiping is reduced.

The predetermined direction may be a scanning direction of the liquid-droplet jetting head.

In the liquid-droplet jetting apparatus according to the present invention, it is preferable that the inclined surface is formed to be annular in a periphery of the nozzle row. In general, a liquid-repellent film is formed on a surface of a nozzle plate. According to the above-described structure, it is possible to prevent, by the second block arranged on the surface of the nozzle plate, a medium onto which the liquid-droplet lands from contacting the surface of the nozzle plate. Therefore, it is possible to prevent occurrence of deviation or the like of the jetting direction of liquid-droplets due to damaging to the liquid-repellent film in the vicinity of the nozzles.

The liquid-droplet jetting apparatus according to the present invention may be an ink-jet printer.

DETAILED DESCRIPTION OF THE PREFERRED EMBODIMENTS

Hereinafter, preferred embodiments of the present invention will be explained with reference to the drawings.

First Embodiment

Figure 1:
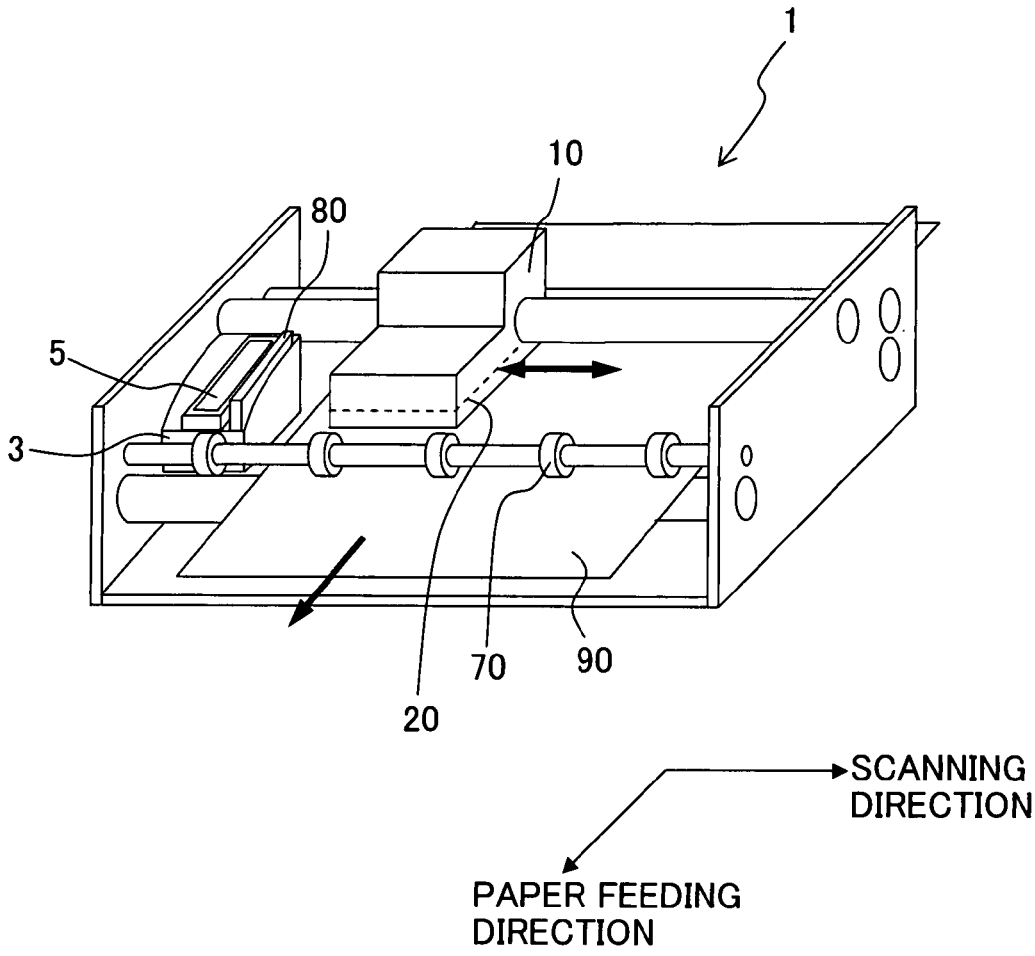
FIG. 1 is a view showing a schematic structure of an ink-jet printer according to a first embodiment of the present invention.

FIG. 1 is a view showing a schematic structure of an ink-jet printer according to this embodiment. As shown in FIG. 1, the ink-jet printer 1 of this embodiment mainly includes a carriage 10 capable of moving in a scanning direction (left and right direction in FIG. 1) by a drive motor (not-shown), a serial-type ink-jet head 20 which jets ink and is supported by the carriage 10 so as to oppose a recording paper 90, and feeding rollers 70 for feeding the recording paper 90 in a paper feeding direction (direction from a right rear side toward a front left side in FIG. 1) orthogonal to the scanning direction. In the ink-jet printer 1 as described above, the ink-jet head 20 jets ink to the recording paper 90 while moving integrally with the carriage 10 in the scanning direction within a printing region. Then, the recording paper 90 recorded by the ink-jet head 20 is discharged in the paper feeding direction by the feeding rollers 70. A maintenance mechanism 3 provided adjacent to the feeding rollers 70 on one end side (maintenance region) in the scanning direction is provided with a suction mechanism (not-shown), a suction cap 5 connected to a pump for example and a wiper 80 made of rubber. When the ink-jet head 20 moves to the maintenance region by the carriage, the suction cap 5 covers the ink-jet head 20, and ink formed on a jetting surface of the ink-jet head 20 is discharged forcibly into the suction cap 5. The wiper 80 moves to be close to the head at predetermined timing when the ink-jet head 20 is present in the maintenance region for example, with the aforementioned drive motor being a power source. When the ink-jet head 20 moves from the maintenance region to a printing region, the wiper 80 wipes ink, dust and/or dirt adhering to the jetting surface (nozzle plate 55 which will be explained later) of the ink-jet head 20.

Figure 2:
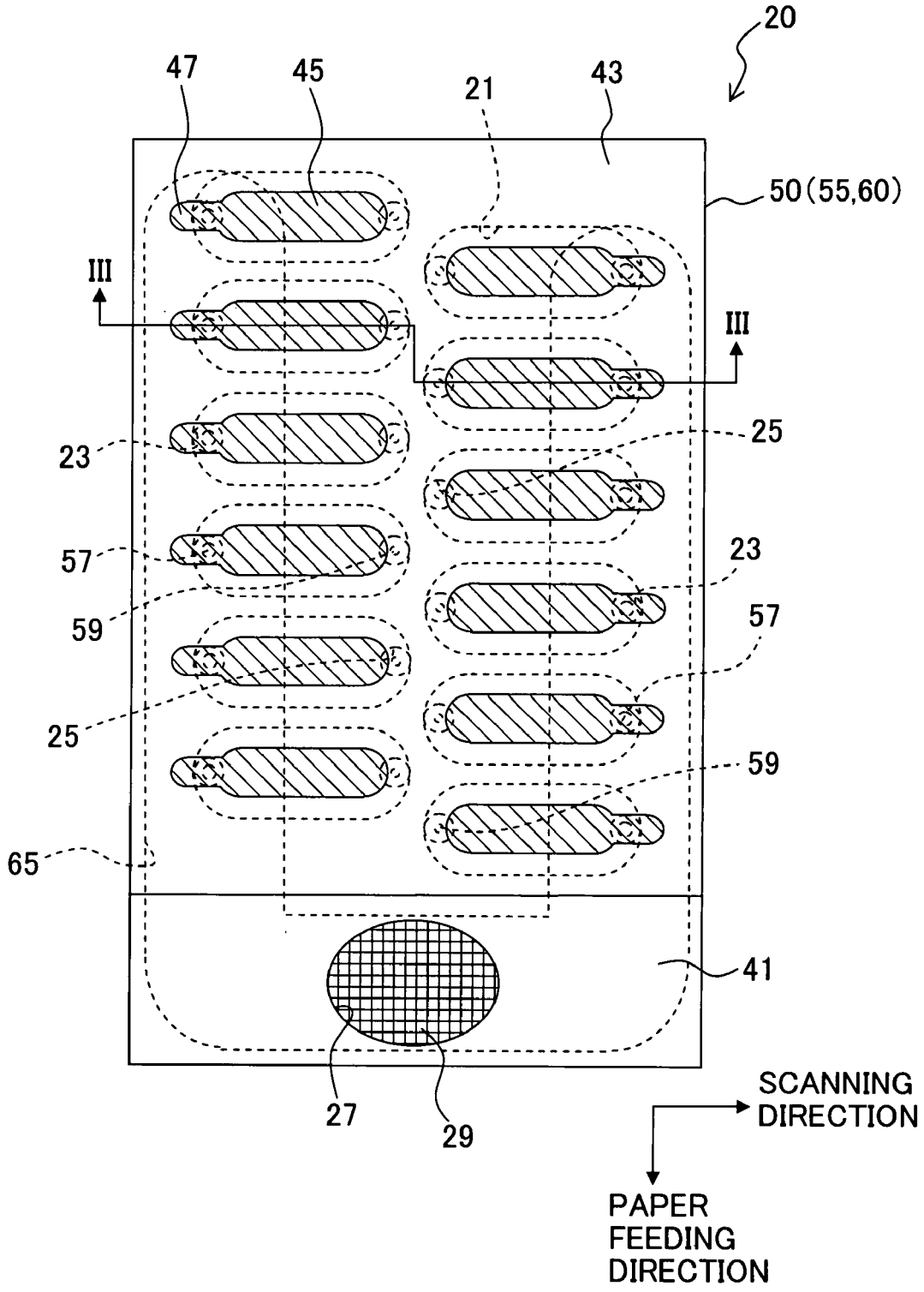
FIG. 2 is a top view of an ink-jet head shown in FIG. 1.
Figure 3:
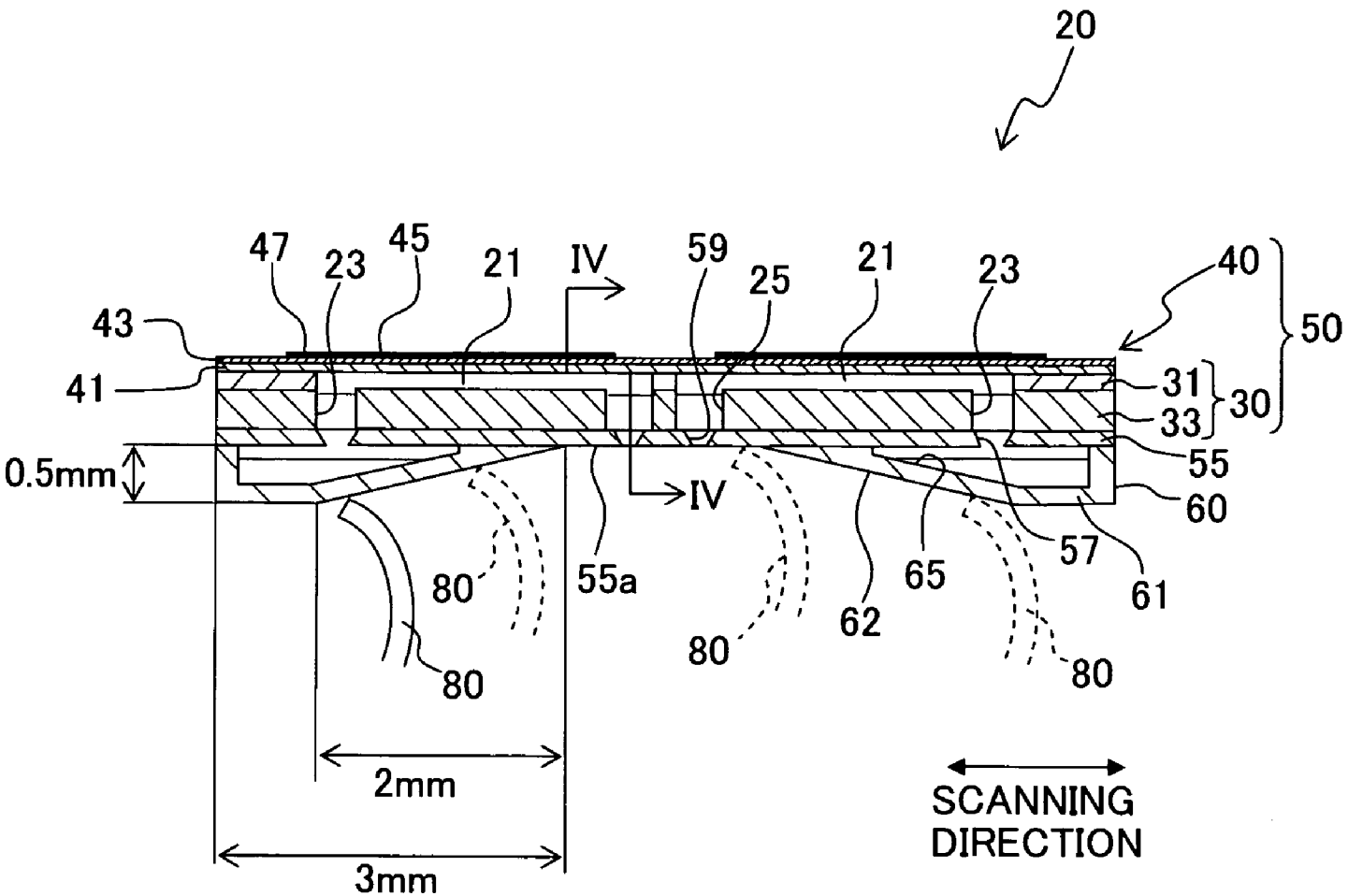
FIG. 3 is a cross-sectional view taken along a line III-III in FIG. 2.
Figure 4:
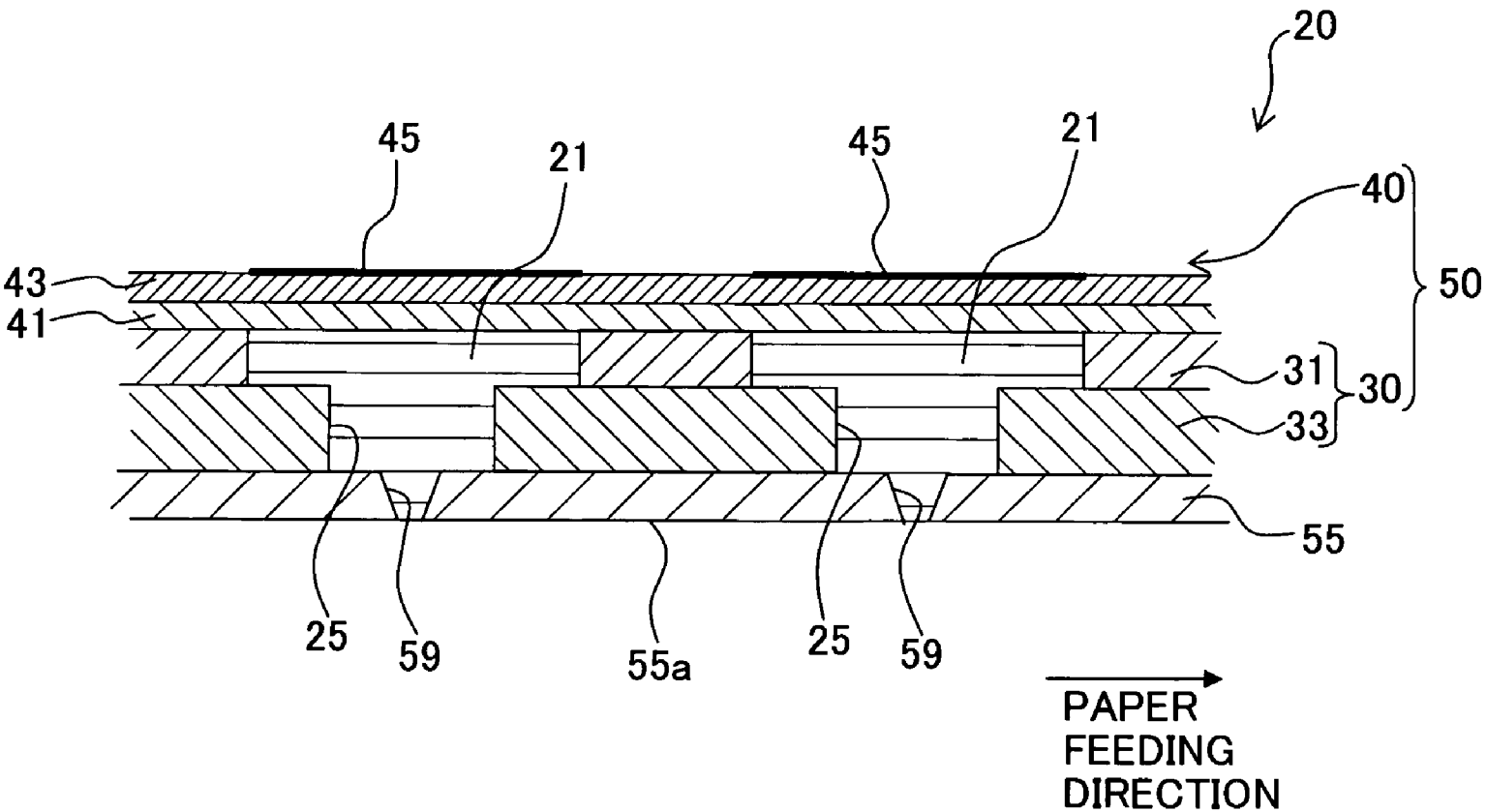
FIG. 4 is a cross-sectional view taken along a line IV-IV in FIG. 3.
Figure 5:
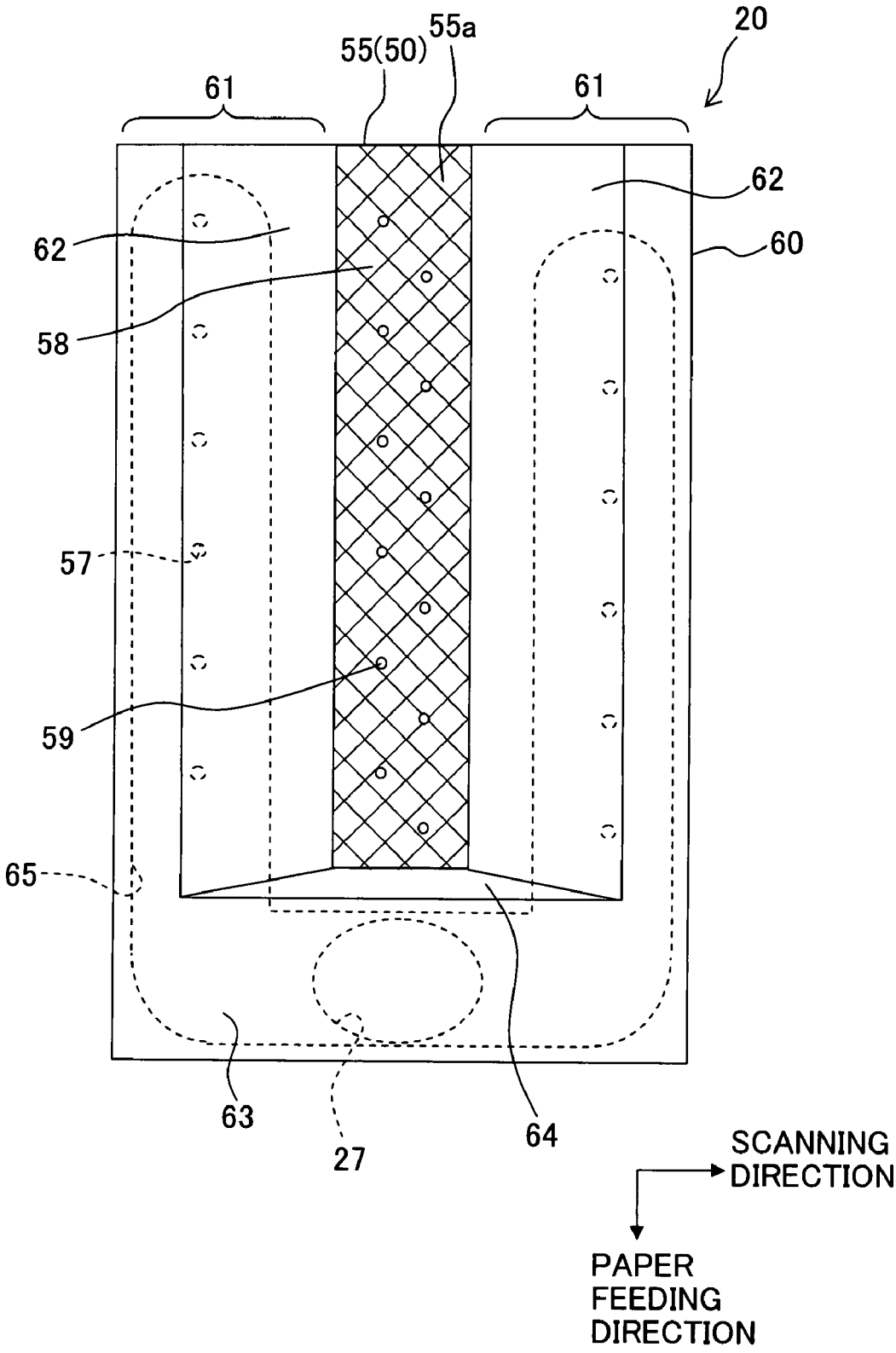
FIG. 5 is a bottom view of the ink-jet head shown in FIG. 1.

Next, with reference to FIG. 2 to FIG. 5, the ink-jet head 20 will be explained in detail. FIG. 2 is a top view of the ink-jet head 20 (view seen from a side opposite to a side opposing the recording paper 90). Also, FIG. 3 is a cross-sectional view taken along a line III-III in FIG. 2, and FIG. 4 is a cross-sectional view taken along a line IV-IV in FIG. 3. Further, FIG. 5 is a bottom view (view seen from a side opposing the recording paper 90) of the ink-jet head 20.

The ink-jet head 20 has a pressure generating block 50 (first block) having a plurality of pressure chambers 21 and a piezoelectric actuator 40 which applies pressure variation to ink in the respective pressure chambers 21, a nozzle plate 55 in which a plurality of nozzles 59 for jetting ink are formed, and a manifold block 60 (second block) in which a manifold 65 for retaining ink is formed. Here, the nozzle plate 55 is joined to a lower face of the pressure generating block 50 (more particularly, a plate stack 30 which will be explained later), and the manifold block 60 is joined to a lower face (a face on a side opposite to the side joined to the pressure generating block 50) of the nozzle plate 55. Then, at positions in the nozzle plate 55 corresponding to the respective pressure chambers 21, the nozzles 59 communicating with the pressure chambers 21 and communication holes 57 allowing communication of the manifold 65 and the pressure chambers 21 are formed respectively. Note that in the ink-jet head 20, the face of a side of the nozzle plate 55 to which the manifold block 60 is joined is an ink jetting surface 55*a* from which ink is jetted.

As shown in FIGS. 3, 4, the pressure chambers 21 are formed inside the plate stack 30 made by joining a cavity plate 31 and a base plate 33 to each other in a stacked state. Therefore, in this embodiment, the pressure generating block 50 is constructed of the plate stack 30 and the piezoelectric actuator 40 arranged on an upper face (face of a side opposite to the side on which the nozzle plate 55 is joined) of the plate stack 30. Note that planar shapes of the cavity plate 31 and the base plate 33 are both a rectangular shape, with a side extending in the scanning direction being a shorter side and a side extending in the paper feeding direction being a longer side. Also, the cavity plate 31 and the base plate 33 are both a plate member made of stainless steel, in which ink channels such as the pressure chambers 21 can be easily formed by etching.

In the cavity plate 31, as shown in FIG. 2, the plurality of pressure chambers 21 arranged in a longitudinal direction (paper feeding direction) are formed in a zigzag form. Namely, two pressure chamber rows adjacent to each other in the scanning direction are formed by the plurality of pressure chambers 21. The plurality of pressure chambers 21 are open toward the side of the piezoelectric actuator 40 (upper sides in FIGS. 3, 4). As shown in FIG. 2, each pressure chamber 21 is formed in a substantially oval shape, which is long in the scanning direction in a plan view.

As shown in FIG. 2 and FIG. 3, in the base plate 33, communication holes 23, 25 each having a circular planar shape are formed respectively at positions overlapping with both end portions in the longitudinal direction of the respective pressure chambers 21 in a plan view. More particularly, the communication holes 23 are formed at positions overlapping with end portions of pressure chambers 21 on a side opposite to an adjacent pressure chamber row with respect to a pressure chamber row to which the aforementioned pressure chambers 21 belong to (namely, in FIGS. 2, 3, on a right side for the pressure chambers 21 arranged on a right side, and on a left side for the pressure chambers 21 arranged on a left side), and allow communication of the manifold 65 and the pressure chambers 21 via the communication holes 57 of the nozzle plate 55. Also, the communication holes 25 are formed in end portions of the pressure chambers 21 on a side opposite to the side where the communication holes 23 are formed (namely, in FIGS. 2, 3, on a left side for the pressure chambers 21 arranged on a right side, and on a right side for the pressure chambers 21 arranged on a left side), and allow communication of the pressure chambers 21 and the nozzles 59 formed in the nozzle plate 55.

Note than among conventional ink-jet heads, there is one in which pressure chambers and a manifold are formed so as to overlap with each other in a stacking direction inside a plate stack, in which a plurality of plates are joined to each other in a stacked state (for example, U.S. Patent Application Publication No. US 2004/119792 A1 corresponding to Japanese Patent Application Laid-open No. 2004-148591). In such a case, the cost thereof increases because the number of expensive metal plates constituting the plate stack increases, as compared to the plate stack 30 provided in the ink-jet head 20 of this embodiment. Particularly, when a manifold is formed across a plurality of metal plates so as to form a manifold having a large volume, the number of metal plates increases further.

The nozzle plate 55 is a plate having a rectangular planar shape similar to the two plates 31, 33 constituting the plate stack 30, and is joined to a lower face of the base plate 33. Here, the nozzle plate 55 is formed of, for example, synthetic polymeric resin material such as polyimide. Alternatively, the nozzle plate 55 may also be formed of a metal material such as stainless steel similar to the plates 31, 33 constituting the plate stack 30. Then, as shown in FIG. 5, on the ink jetting surface 55*a* of the nozzle plate 55, there is formed a liquid-repellent film 58 having a high liquid repellency for preventing wetting with ink in the vicinity of the nozzles 59. The liquid-repellent film 58 is formed of fluorine-based resin (for example, ethylene tetrafluoride) or the like.

As shown in FIGS. 2, 3, in the nozzle plate 55, the communication holes 57 allowing communication of the manifold 65 and the pressure chambers 21 are formed at positions overlapping with the communication holes 23 of the base plate 33 in a plan view, and the nozzles 59 communicating with the pressure chambers 21 are formed at positions overlapping with the communication holes 25 of the base plate 33. Namely, as shown in FIGS. 2, 5, in the nozzle plate 55, the plurality of nozzles 59 are arranged in a zigzag form in the paper feeding direction in the vicinity of a middle portion thereof in the scanning direction, and thereby two nozzle rows are formed. Also, in the vicinity of each of end portions of the nozzle plate 55 in the scanning direction, the plurality of communication holes 57 are arranged in one row in the paper feeding direction. Note that the communication holes 57 and the nozzles 59 are formed by excimer laser processing.

The manifold block 60 is made of resin such as, for example, PP (polypropylene), POM (polyacetal), PPS (polyphenylene sulfide) or the like, and is formed by injection molding. Also, the manifold block 60 has, as shown in FIG. 5, two extended portions 61 which are formed in both ends in the scanning direction and extend in the paper feeding direction and a coupling portion 63 which extends in the scanning direction and couples one ends (lower ends in FIG. 5) of the two extended portions 61, and the manifold block 60 is a member having a planar shape in a substantially U shape as the whole. A length of the outline of the manifold block 60 in the scanning direction and a length thereof in the paper feeding direction both substantially match the pressure generating block 50 and the nozzle plate 55. Then, as shown in FIGS. 3, 5, the manifold block 60 is adhered to the ink jetting surface 55*a* of the nozzle plate 55 so as not to block the nozzles 59, namely, so as to surround the nozzle rows from three directions. Specifically, as shown in FIG. 3, the manifold block 60 projects downward from the ink jetting surface 55*a*. At this time, the two extended portions 61 of the manifold block 60 extend in parallel to each other with the nozzle rows intervening therebetween.

Then, inside the manifold block 60, the manifold 65 having a substantially U shape is formed. As shown in FIG. 3, the manifold 65 is open toward the side of the nozzle plate 55. Further, as shown in FIGS. 2, 3, the manifold 65 formed inside the extended portions 61 overlaps with right half portions of the pressure chambers 21 arranged on the right side and left half portions of the pressure chambers 21 arranged on the left side in a plan view, respectively. Accordingly, the manifold 65 communicates with the pressure chambers 21 via the communication holes 57, 23. Also, as will be explained later, an ink supply path 27 is connected to the manifold 65, and ink is supplied from an ink tank (not shown) via the ink supply path 27.

Further, as shown in FIG. 5, the two extended portions 61 and the coupling portion 63 have inclined surfaces 62, 64 respectively, which incline toward the ink jetting surface 55*a*. The inclined surfaces 62 formed respectively on the two extended portions 61 extend in the paper feeding direction, and are continuous to the ink jetting surface 55*a* via end portions thereof on sides near the rows of the nozzles 59. Also, the inclined surface 64 formed on the coupling portion 63 couples one end portions (lower end portions in FIG. 5) of the inclined surfaces 62 with each other, which are formed respectively on the two extended portions 61, and is continuous to the ink jetting surface 55*a* via an end portion thereof on a side near the rows of the nozzles 59. Specifically, the inclined surfaces 62, 64 are formed in a substantially U shape on the periphery of the rows of the nozzles 59. Then, as shown in FIG. 3, the inclined surfaces 62 incline such that the farther a certain point thereon from the rows of the nozzles 59 in the scanning direction, the farther the certain point from the nozzle plate 55 in a height direction (direction perpendicular to the ink jetting surface 55*a*). In other words, the inclined surfaces 62 are formed so that a distance from the surface of the nozzle plate 55 is increased at positions separated away further from in a predetermined direction in which the liquid droplet jetting head is moved.

Here, as shown in FIG. 3, in this embodiment, it is assumed that a length of one of the extending portions 61 of the manifold block 60 in the scanning direction is 3 mm, and in this length, a length of a portion where one of the inclined surfaces 62 is formed in the scanning direction is 2 mm. Also, it is assumed that a height of the manifold block 60 (length in the direction perpendicular to the ink jetting surface 55*a*) is set to 0.5 mm. Namely, the inclined surface 62 has a degree of inclination such that a certain point thereon separated by 2 mm in the scanning direction is separated by 0.5 mm from the nozzle plate 55.

With the structure as above, the manifold 65 communicates with the end portions of the pressure chambers 21 via the communication holes 57, 23, and moreover, the end portions of the pressure chambers 21 on the side opposite to the side communicating with the manifold 65 communicate with the nozzles 59 via the communication holes 25. Thus, in the ink-jet head 20, a plurality of individual ink channels reaching the nozzles 59 from the manifold 65 via the pressure chambers 21 are formed across the pressure generating block 50, the nozzle plate 55, and the manifold block 60. Then, the ink-jet head is constructed such that, when pressure is applied to ink in the respective pressure chambers 21 by the piezoelectric actuator 40, liquid droplets of the ink can be jetted respectively from the nozzles 59 communicating with the pressure chambers 21.

Next, the piezoelectric actuator 40 will be explained. As shown in FIGS. 3, 4, the piezoelectric actuator 40 includes a vibration plate 41 arranged on an upper face of the plate stack 30, a piezoelectric layer 43 formed on an upper face (face of a side opposite to the pressure chambers 21) of the vibration plate 41, and a plurality of individual electrodes 45 formed corresponding to the plurality of pressure chambers 21 respectively on an upper face of the piezoelectric layer 43.

The vibration plate 41 is a plate formed of a metal material in a rectangular shape in a plan view, and is made of, for example, iron based alloy such as stainless steel, copper based alloy, nickel based alloy, titanium based alloy, or the like. This vibration plate 41 is disposed on an upper face of the cavity plate 31 so as to cover the plurality of pressure chambers 21, and joined to the upper face of the cavity plate 31. Also, the vibration plate 41 made of metal has electrical conductivity, and serves also as a common electrode which allows an electric field to operate on the piezoelectric layer 43 sandwiched between the vibration plate 41 and the individual electrodes 45. Note that the vibration plate 41 is grounded and maintained at the ground potential constantly.

On a surface of the vibration plate 41, there is formed the piezoelectric layer 43 whose main constituent is lead zirconate titanate (PZT), which is solid solution of lead titanate and lead zirconate and is ferroelectric. As shown in FIG. 2, this piezoelectric layer 43 is formed sequentially across the plurality of pressure chambers 21 on the upper face of the vibration plate 41. Here, the piezoelectric layer 43 can be formed using, for example, aerosol deposition method (AD method) which sprays very small particles of a piezoelectric material on a substrate to make them collide at high speed, to thereby deposit the particles on the substrate. Alternatively, the piezoelectric layer 43 may be formed by sputtering method, chemical vapor method (CVD method), sol-gel method, hydrothermal crystallization method, or the like.

On an upper face of the piezoelectric layer 43, the plurality of individual electrodes 45 each having an oval planar shape that is smaller to some extent than one of the pressure chambers 21 are formed respectively at positions overlapping with center portions of the respective pressure chambers 21 in a plan view. Here, the individual electrodes 45 are constituted of a conductive material such as gold, copper, silver, palladium, platinum, titanium, or the like. Further, on sides of one end portions (sides overlapping with end portions of the pressure chambers 21 on the side communicating with the manifold 65 in a plan view) of the respective individual electrodes 45 on the upper face of the piezoelectric layer 43, terminal portions 47 are formed respectively. The terminal portions 47 are connected to a drive circuit such as a driver IC via a wiring member having flexibility such as a flexible printed circuit, and are constructed so that a drive voltage is applied selectively to the plurality of individual electrodes 45. The plurality of individual electrodes 45 and the plurality of terminal portions 47 can be formed by, for example, screen printing method, sputtering method, vapor deposition method, or the like.

Here, the operation of the piezoelectric actuator 40 will be explained. When a drive potential is applied selectively to the plurality of individual electrodes 45, a potential difference is generated between an individual electrode 45 to which the drive potential is applied and the vibration plate 41 which faces the individual electrodes 45 and is kept at the ground potential and functions as a common electrode, thereby generating an electric field in a thickness direction of the piezoelectric layer 43 in a portion thereof which is sandwiched between the individual electrode 45 and the vibration plate 41. Then, the portion of the piezoelectric layer 43 corresponding to the individual electrode 45 to which the drive potential is applied contracts in a horizontal direction, which is orthogonal to the thickness direction that is a polarization direction. At this time, accompanying with the contraction of the piezoelectric layer 43, the vibration plate 41 is deformed to project toward a pressure chamber 21, and hence the volume of the pressure chamber 21 is reduced and pressure is applied to the ink in the pressure chamber 21. Thus, a liquid-droplet of the ink is jetted from a nozzle 59 communicating with the pressure chamber 21.

Also, as shown in FIG. 2, on one end side in the longitudinal direction of the vibration plate 41 (lower side in FIG. 2), a through hole having an oval shape is formed. This through hole communicates with the manifold 65 formed in the manifold block 60, and constitutes a part of the ink supply path 27. Namely, through holes constituting the ink supply path 27 are formed similarly at positions on the cavity plate 31, the base plate 33, and the nozzle plate 55 respectively overlapping with the aforementioned through hole of the vibration plate 41 in a plan view. Then, the ink supply path 27 communicates with the not-shown ink tank. Further, a filter 29 is disposed on an end portion of the ink supply path 27 located on the surface of the vibration plate 41. Thus it is possible to prevent a foreign object such as dust from entering the inside of the ink-jet head 20.

Further, in the ink-jet printer 1, the wiper 80 made of rubber (see FIG. 3) is provided in a fixed manner outside a transport path of the recording paper 90 in a moving path of the ink-jet head 20 by the carriage 10. The wiper 80 is disposed orthogonal to the ink jetting surface 55*a*. Then, when the ink-jet head 20 is at a wiping position where the wiper 80 is disposed, the vicinity of a tip of the wiper 80 abut on the lower face of the ink-jet head 20, more specifically, the inclined surface 62 of the manifold block 60 or the ink jetting surface 55*a*. Therefore, by moving the ink-jet head 20 in the scanning direction at the wiping position, wiping for wiping off ink adhering to the ink jetting surface 55*a* is performed.

Here, movement of the wiper 80 when the wiping is performed will be explained. As shown in FIG. 3, first the wiper 80 rubs on the inclined surface 62 of the extended portion 61 located on one side (left side in the drawing) of the nozzle rows with respect to the scanning direction. At this time, the wiper 80 having flexibility moves along the inclined surfaces 62 while deforming. Subsequently, from one end portions continuous to the ink jetting surface 55*a* of the inclined surfaces 62, the wiper 80 moves smoothly onto the ink jetting surface 55*a* to thereby wipes off ink on the ink jetting surface 55*a*. Thereafter, the wiper 80 can move smoothly to the inclined surface 62 of the extended portion 61 located on the other side (right side in the diagram) of the nozzle rows.

As described above, in the ink-jet printer 1 of this embodiment, the ink-jet head 20 is provided with the pressure generating block 50 having the plurality of pressure chambers 21 and the piezoelectric actuator 40 which applies pressure variation to ink in the pressure chambers 21, the nozzle plate 55 which is joined to the pressure generating block 50 and in which the plurality of nozzles 59 communicating respectively with the respective pressure chambers 21 are formed, and the manifold block 60 which is joined to the ink jetting surface 55*a* on the side opposite to the side on which the pressure generating block 50 of the nozzle plate 55 is joined and in which the manifold 65 which retains ink to be supplied to the respective pressure chambers 21 is formed, and in the nozzle plate 55, the communication holes 57 for allowing communication of the manifold 65 and the respective pressure chambers 21 are formed. Then, the manifold block 60 has the inclined surfaces 62 which incline toward the ink jetting surface 55*a* and are continuous via the end portions thereof to the ink jetting surface 55*a*. Also, the inclined surfaces 62 are arranged on both sides of the nozzle rows with respect to the scanning direction of the ink-jet head 20. Therefore, when the wiper 80 is used to wipe the ink jetting surface 55*a* in the scanning direction, the wiper 80 can move smoothly from one of the inclined surfaces 62 to the ink jetting surface 55*a*, and from the ink jetting surface 55*a* to the other one of the inclined surfaces 62, without being caught by the manifold block 60. Therefore, ink adhering to the ink jetting surface 55*a* can be wiped off by the wiper 80.

Figure 11:
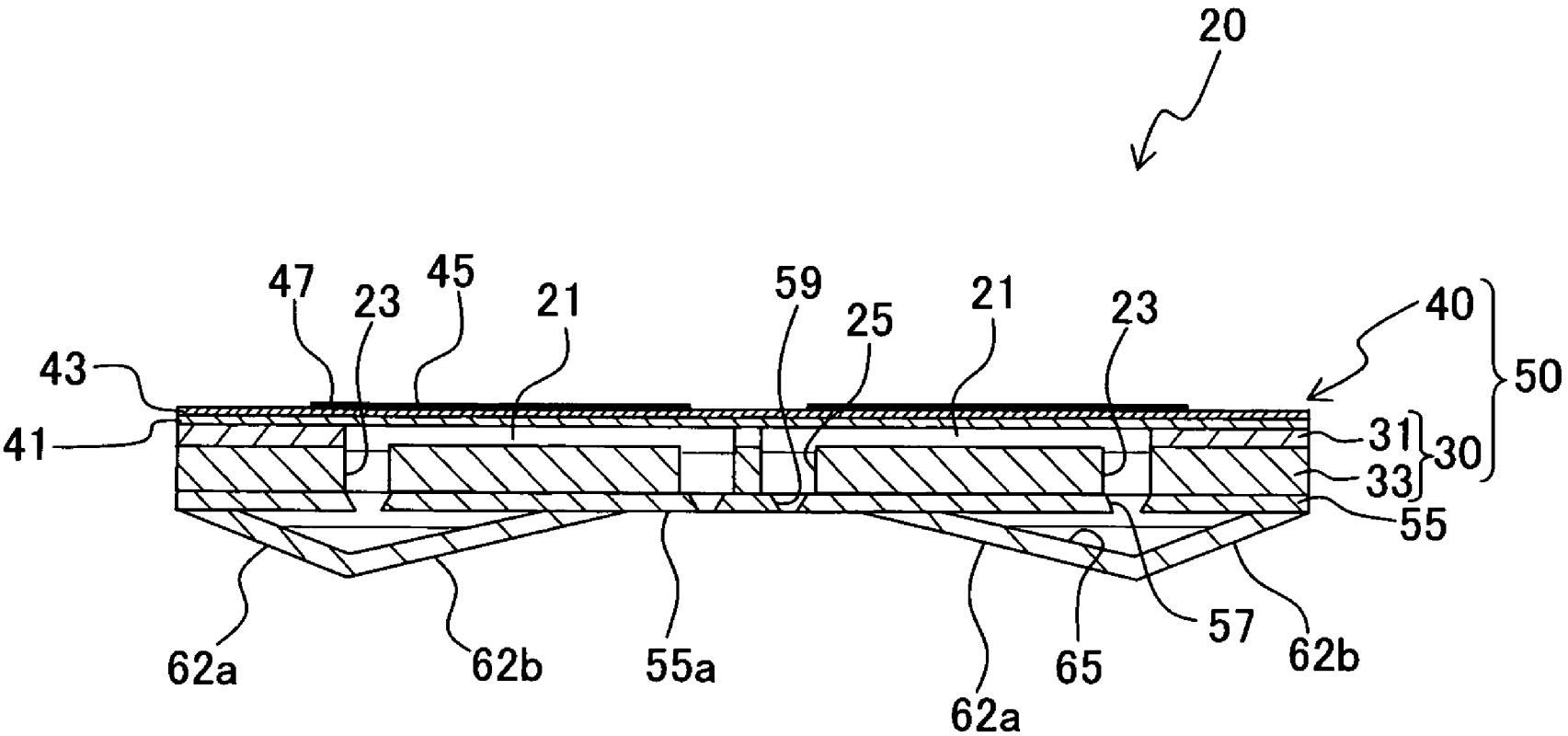
FIG. 11 is a side view of the case where shapes of inclined surfaces of a manifold block are deformed.

Note that the shapes of the inclined surfaces of the manifold block, which are planar shapes, are not limited thus. Although not shown, the shapes of the inclined surfaces may be a recessed shape or projecting shape with respect to the nozzle plate. In this manner, contact resistance between the wiper and the inclined surfaces becomes low, and the operating life of the wiper becomes long. Also, as shown in FIG. 11, the inclined surfaces of the manifold block may each be constituted of a first inclined surface 62*a* and a second inclined surface 62*b*, the first inclined surface 62*a* having one end continuous to the nozzle plate 55 and the other end connected to one end of the second inclined surface 62*b*, and the second inclined surface 62*b* having one end connected to the other end of the first inclined surface 62*a* and the other end continuous to the nozzle plate 55. With such a structure, contact resistance between the inclined surfaces 62*a*, 62*b* and the wiper can be reduced. In this case, a connecting portion of the first inclined surface 62*a* and the second inclined surface 62*b* may be a curved face so as to continue smoothly. By the curved face, the wiper can move more smoothly.

Also, in the above-described embodiment, since the pressure chambers 21 and the manifold 65 are arranged respectively on the sides opposite to each other with respect to the nozzle plate 55 in which the nozzles 59 are formed, channel lengths between outlets of the pressure chambers 21 and the nozzles 59 becomes short as compared to the case where the manifold 65 is arranged between the pressure chambers 21 and the nozzle plate 55. Therefore, a force needed to jet ink from the nozzles 59 becomes relatively small, which can reduce power consumption.

Moreover, in the ink-jet printer 1 of this embodiment, the manifold block 60 is produced by injection molding. Therefore, the manifold block 60 can be produced with a fewer number of steps as compared to the case where the manifold block 60 is produced by joining a plurality of members with each other, or the like. Also, the manifold block 60 in a desired shape can be produced easily.

In addition, in the ink-jet printer 1 of this embodiment, the manifold block 60 is made of resin. Therefore, as compared to one made of metal, the manifold block 60 can be produced at low cost. Also, for example, when the manifold 65 is formed inside the plate stack 30 so as to overlap with the pressure chambers 21 in the stacking direction, the number of stacked metal plates of the plate stack 30 becomes large, which increases the cost thereof. In this embodiment, since the manifold 65 is formed in the manifold block 60, which is a member separated from the plate stack 30 and made of resin, the number of stacked metal plates constituting the plate stack 30 can be reduced, and thus the cost for the entire ink-jet head 20 can be reduced.

Also, in the ink-jet printer 1 of this embodiment, since the manifold block 60 having the inclined surfaces 62, 64 formed in a substantially U shape on the periphery of the nozzle rows is joined to the ink jetting surface 55*a*, it is possible to prevent the recording paper 90 from contacting the ink jetting surface 55*a*. Therefore, damage to the liquid-repellent film 58 formed on the ink jetting surface 55*a* can be prevented. When the liquid-repellent film 58 gets damaged, wetting with ink can easily occur in the damaged position. Thus, it is possible to prevent occurrence of dispersion in jetting direction or jetting amount of ink caused by ink remaining in the vicinity of the nozzles 59 due to damage to the liquid-repellent film 58 in the vicinity of the nozzles 59.

Second Embodiment

Figure 6:
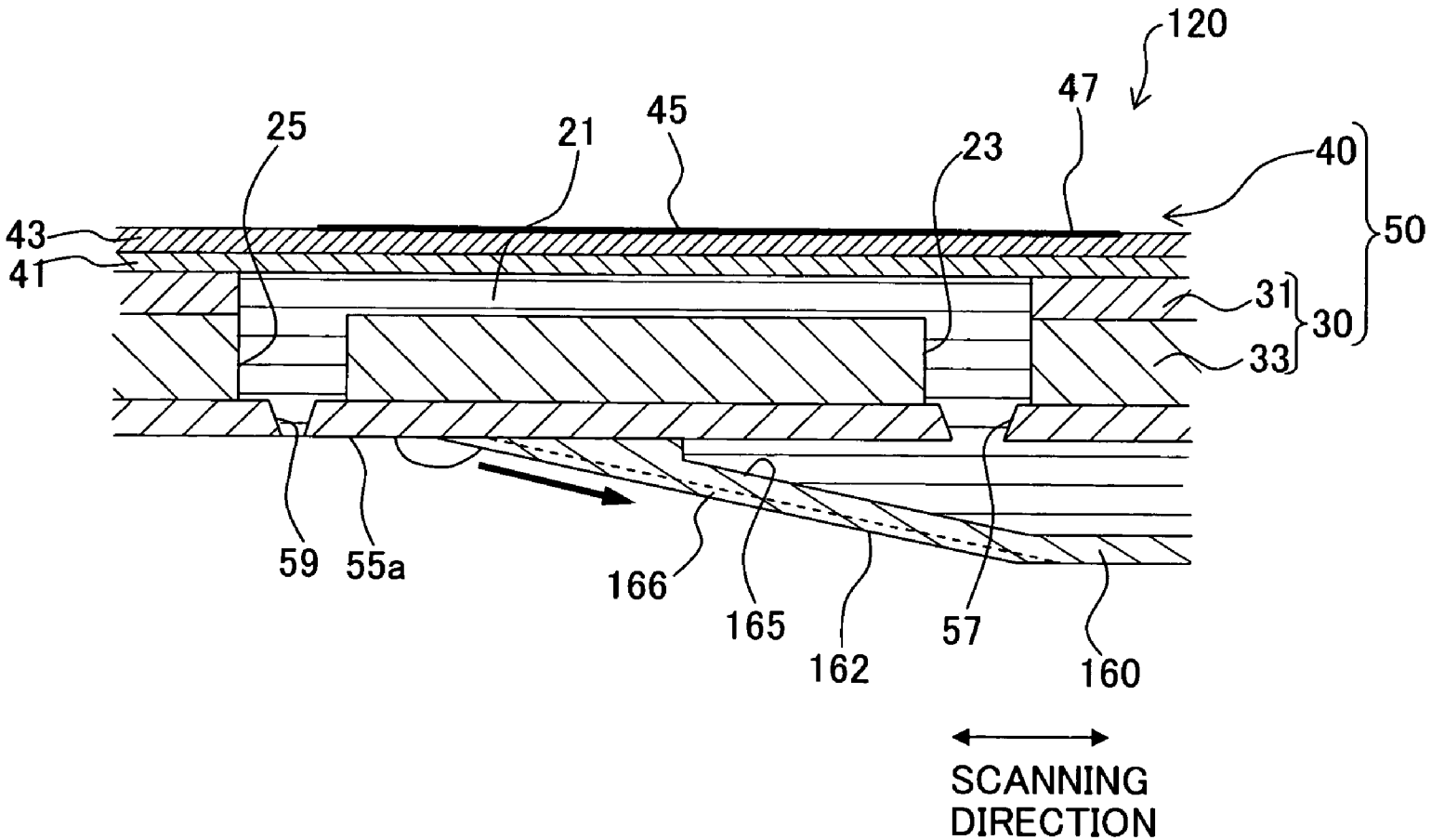
FIG. 6 is a partial cross-sectional view taken along a scanning direction of an ink-jet head according to a second embodiment of the present invention.
Figure 7:
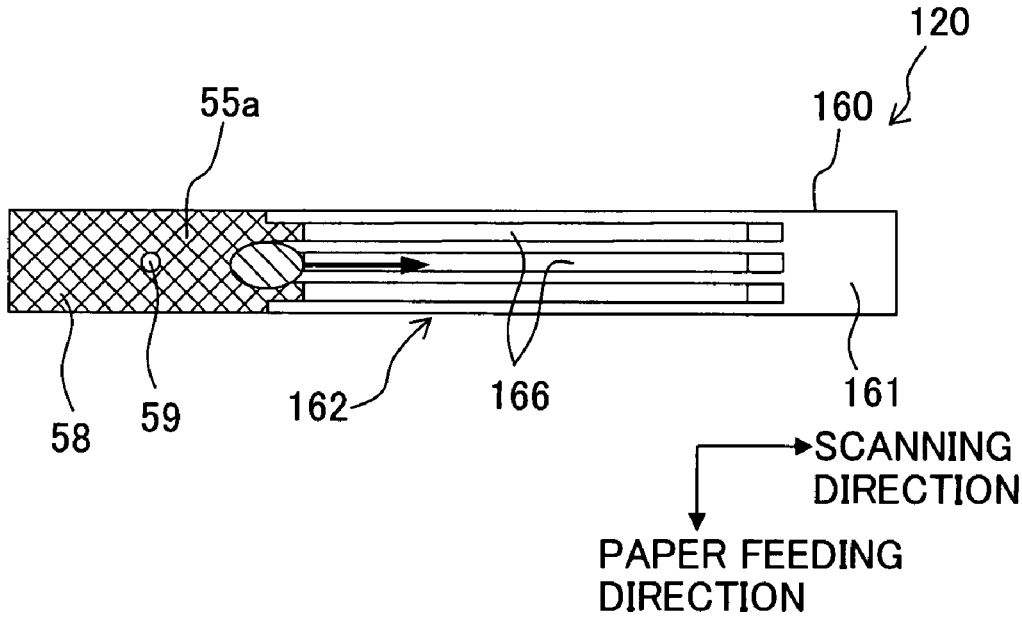
FIG. 7 is a bottom view of an ink-jet head shown in FIG. 6.

Next, with respect to FIGS. 6, 7, a second embodiment of the present invention will be explained. FIG. 6 is a partial cross-sectional view taken along a scanning direction of an ink-jet head of this embodiment, and FIG. 7 is a bottom view of a part shown in FIG. 6 in the ink-jet head of this embodiment. The ink-jet head 120 of this embodiment is similar to the first embodiment except that grooves 166 are formed in an inclined surface 162 of a manifold block 160. Note that in the following explanation, components having same structures as those in the first embodiment are designated the same reference numerals, and explanations thereof are omitted accordingly.

As shown in FIGS. 6, 7, in the inclined surface 162, a plurality of grooves 166 are formed, which extend from an end portion of the inclined surface 162 on a side continuous to the ink jetting surface 55*a* in a direction (scanning direction) separating away from the nozzles 59. Also, the grooves 166 are formed integrally when the manifold block 160 is produced by injection molding of resin.

As above, similarly to the ink-jet head 20 of the first embodiment, the wiper 80 of the ink-jet head 120 of this embodiment can wipe off ink adhering to the ink jetting surface 55*a*.

Also, in the ink-jet head 120 of this embodiment, when ink adhering to the ink jetting surface 55*a* contacts one ends of the grooves 166, the ink is sucked into the grooves 166 by capillary force, and is transported in the direction away from the nozzles 59. Namely, the grooves 166 formed in the inclined surface 162 function as a transporting structure for transporting the ink adhering to the ink jetting surface 55*a* in the direction away from the nozzles 59. By the inclined surface 162 having the transporting structure, it is possible to keep the vicinity of the nozzles 59 clean even when the number of times of wiping is reduced. Moreover, the ink sucked into the grooves 166 are retained in the grooves 166 by the capillary force. Therefore, it is possible to prevent staining of the recording paper 90 or the transport path of the recording paper 90 by dripping of the ink. In addition, the recording paper 90 arranged opposing the ink jetting surface 55*a* does not easily contact the ink retained in the grooves 166 formed in the inclined surface 162, and thus staining of the recording paper 90 can be prevented. Also, as compared to the case where the grooves 166 are formed in parallel to the ink jetting surface 55*a*, the extending lengths of the grooves 166 can be made long. Thus, a larger amount of ink can be retained in the grooves 166.

Further, in the ink-jet head 120 of this embodiment, since the manifold block 160 is produced by injection molding, the grooves 166 can be formed easily.

First Modification

Figure 8:
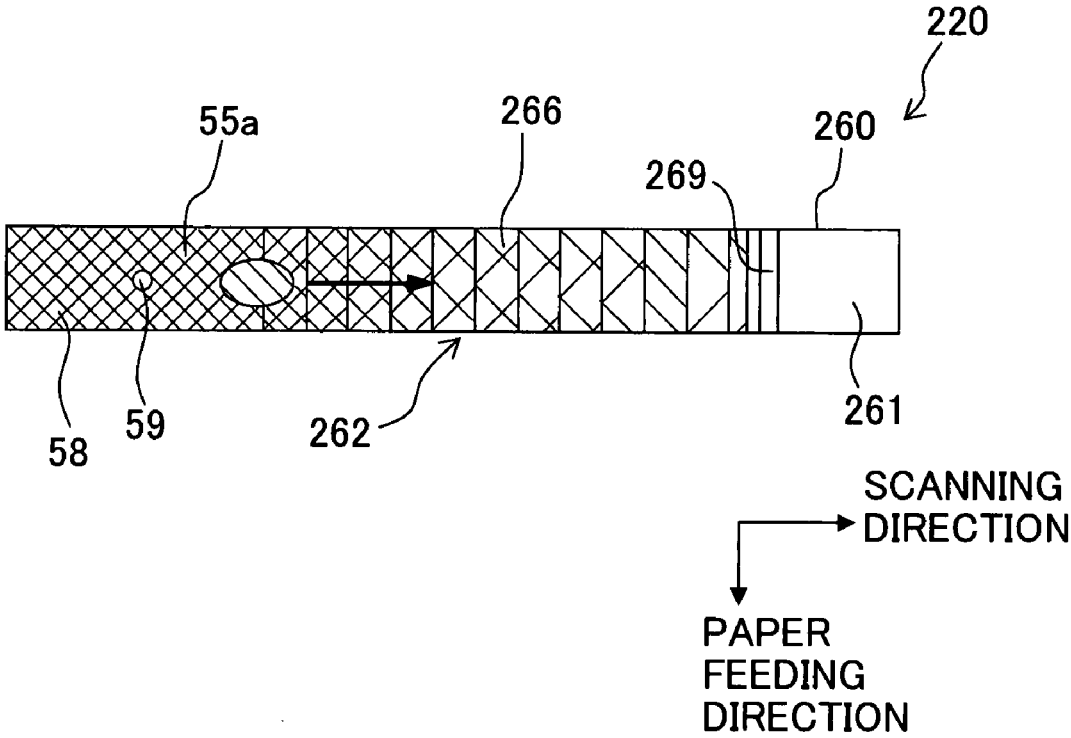
FIG. 8 is a view showing a part of a lower face of an ink-jet head according to a first modification of the second embodiment of the present invention.

Here, with reference to FIG. 8, a first modification of the second embodiment will be explained. FIG. 8 is a view showing a part of a lower face of an ink-jet head according to this modification, and corresponds to FIG. 7 of the second embodiment. In this modification, the grooves 166 formed in the inclined surface 162 as the transporting structure in the second embodiment are changed to a transport surface 266.

As shown in FIG. 8, the transport surface 266 is divided into a plurality of areas (regions) which are adjacent to each other from an end portion of an inclined surface 262 on a side continuous to the ink jetting surface 55*a* in a direction (scanning direction) to separated away from the nozzles 59. Then, among the areas, a liquid repellency of an area located in the end portion (end portion on the left side in FIG. 8) on the side continuous to the ink jetting surface 55*a* is not more than the liquid repellency of the liquid-repellent film 58 formed on the ink jetting surface 55*a*, and as an area is located further away (toward an end portion on the right side in FIG. 8) from the nozzles 59, the liquid repellency thereof is further reduced or lowered. Note that the width (length in the scanning direction) of each of the areas is preferred to be smaller than the diameter of a liquid-droplet on the ink jetting surface 55*a*. Also, the transport surface 266 is formed of a liquid-repellent film formed of fluorine based resin or the like for example. In this modification, the liquid-repellent film forming the transport surface 266 is formed in a different step from that for the liquid-repellent film 58 of the ink jetting surface 55*a*.

Further, on a lower face of the manifold block 260 of this modification, a groove 269 extending in the paper feeding direction is formed. As shown in FIG. 8, the groove 269 is formed adjacent to an end portion on a side opposite to the side of the inclined surface 262 continuous to the ink jetting surface 55*a*, namely, the end portion on the side of an area of the transport surface 266 having the lowest liquid repellency. Accordingly, ink transported by the transport surface 266 is retained in the groove 269 by capillary force. Note that the ink retained in the groove 269 is removed by pressing an absorber (not-shown) against the groove 269.

According to this modification, when ink adhering to the ink jetting surface 55*a* contacts one end of the transport surface 266, the ink is transported in the direction (rightward in FIG. 8) away from the nozzles 59, so as to move toward an area with a lower liquid repellency. Namely, the transport surface 266 formed in the inclined surface 262 functions as a transporting structure which transports the ink adhering to the ink jetting surface 55*a* in the direction to depart from the nozzles 59, and thus the vicinity of the nozzles 59 can be kept clean even when the number of times of wiping is decreased.

Also, in the above-described modification, ink transported by the transport surface 266 is retained in the groove 269 formed in the vicinity of the area of the transport surface 266 having the lowest liquid repellency. Therefore, it is possible to prevent staining of the recording paper 90 or the transport path of the recording paper 90 by dripping of the ink.

Second Modification

Figure 9:
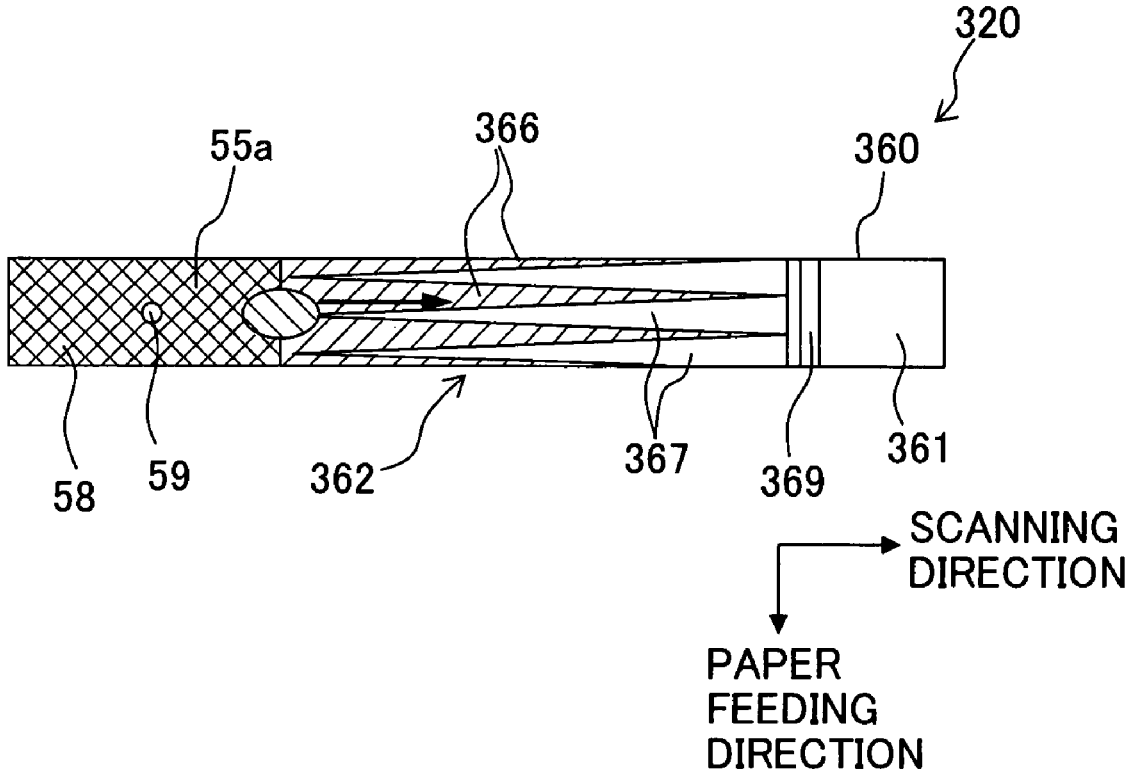
FIG. 9 is a view showing a part of a lower face of an ink-jet head according to a second modification of the second embodiment of the present invention.

Next, with reference to FIG. 9, a second modification of the second embodiment will be explained. FIG. 9 is a view showing a part of a lower face of an ink-jet head according to this modification, and corresponds to FIG. 7 of the second embodiment. In this modification, the grooves 166 formed in the inclined surface 162 as the transporting structure in the second embodiment are changed to high liquid-repellent areas 366 and low liquid-repellent areas 367.

Here, the high liquid-repellent areas 366 have a liquid repellency that is not more than that of the liquid-repellent film 58 formed on the ink jetting surface 55*a*, and the low liquid-repellent areas 367 have a liquid repellency that is lower than that of the high liquid-repellent areas 366. As shown in FIG. 9, the high liquid-repellent areas 366 and the low liquid-repellent areas 367 both extend from an end portion of the inclined surface 362 on a side continuous to the ink jetting surface 55*a* in a direction (scanning direction) separating away from the nozzles 59, and formed alternately in the paper feeding direction. Then, the high liquid-repellent areas 366 have widths which is decreased from an end portion on a side of the ink jetting surface 55*a* in the direction to separate away from the nozzles 59, and end portions (end portions on a right side in FIG. 9) which are farthest from the nozzles 59 are pointed ends. Also, the low liquid-repellent areas 367 have widths which is increased from the end portion on the side of the ink jetting surface 55*a* in the direction separating away from the nozzles 59, and end portions (end portions on a left side in FIG. 9) on the side of the ink jetting surface 55*a* are pointed ends. Namely, the high liquid-repellent areas 366 and the low liquid-repellent areas 367 are both patterned in a zigzag shape.

In this modification, first on the entire inclined surface 362, a liquid-repellent film having a liquid repellency equivalent to the high liquid-repellent areas 366 is formed by fluorine-based resin or the like for example. Note that it is assumed that the liquid-repellent film has a liquid repellency higher than a liquid repellency of the surface of the manifold block 360, and is not more than a liquid repellency of the liquid-repellent film 58 formed on the ink jetting surface 55*a*. Thereafter, by removing the portions corresponding to the low liquid-repellent areas 367 of the liquid-repellent film by laser or the like, the high liquid-repellent areas 366 and the low liquid-repellent areas 367 are formed. Also, in this modification, the liquid-repellent film formed on the inclined surface 362 is formed in a step separated from that for the liquid-repellent film 58 of the ink jetting surface 55*a*.

Further, on a lower face of the manifold block 360 of this modification, a groove 369 extending in the paper feeding direction is formed. As shown in FIG. 9, the groove 369 is formed adjacent to an end portion on a side opposite to the side of the inclined surface 362 continuous to the ink jetting surface 55*a*, namely, the end portion on the side where widths of the low liquid-repellent areas 367 are widest. Accordingly, ink transported by the high liquid-repellent areas 366 and the low liquid-repellent areas 367 is retained in the groove 369 by capillary force. Note that the ink retained in the groove 369 is removed by pressing an absorber (not-shown) against the groove 369.

In this modification, when ink adhering to the ink jetting surface 55*a* contacts the region where the high liquid-repellent areas 366 and the low liquid-repellent areas 367 are patterned, the ink wets and spreads in the low liquid-repellent areas 367 extending in the scanning direction. Namely, the high liquid-repellent areas 366 and the low liquid-repellent areas 367 formed in the inclined surface 362 function as a transporting structure which transports the ink adhering to the ink jetting surface 55*a* in the direction away from the nozzles 59, and thus the vicinity of the nozzles 59 can be kept clean even when the number of times of wiping is decreased.

Further, in the above-described modification, first the liquid-repellent film having a liquid repellency equivalent to the high liquid-repellent areas 366 is formed, and thereafter the liquid-repellent film formed on the portions corresponding to the low liquid-repellent areas 367 are removed. Thus, the high liquid-repellent areas 366 and the low liquid-repellent areas 367 which function as a transporting structure can be formed. Therefore, for example, as compared to the case where the transporting structure has three or more areas having liquid repellencies different from each other, the transporting structure can be formed easily.

Also, since the low liquid-repellent areas 367 have widths which are decreased on the side of the ink jetting surface 55*a*, ink adhering to the ink jetting surface 55*a* is sucked by the low liquid-repellent areas 367 by capillary force. Therefore, the ink can be moved securely in a direction separating away from the nozzles 59. Further, since the low liquid-repellent areas 367 have widths which is increased in the direction separating away from the nozzles 59, the ink wets and spreads in the low liquid-repellent areas 367 without dripping even when an amount of the ink to be sucked into the low liquid-repellent areas 367 is relatively large.

Additionally, since the end portions of the low liquid-repellent areas 367 on the side of the ink jetting surface 55*a* are the pointed ends, the surface of a liquid-droplet of ink adhering to the ink jetting surface 55*a* breaks at the pointed ends (left end in FIG. 9) of the low liquid-repellent areas 367, and the ink can smoothly wet the low-liquid repellent areas 367 and spread in the low liquid-repellent areas 367 (rightward in FIG. 9).

Also, in the above-described modification, ink transported by the high liquid-repellent areas 366 and the low liquid-repellent areas 367 is retained in the groove 369 formed in the vicinity of the end portion on the side of the low liquid-repellent areas 367 where the widths thereof are the widest. Therefore, it is possible to prevent staining of the recording paper 90 and/or the transport path of the recording paper 90 by dripping of ink.

Third Embodiment

Figure 10:
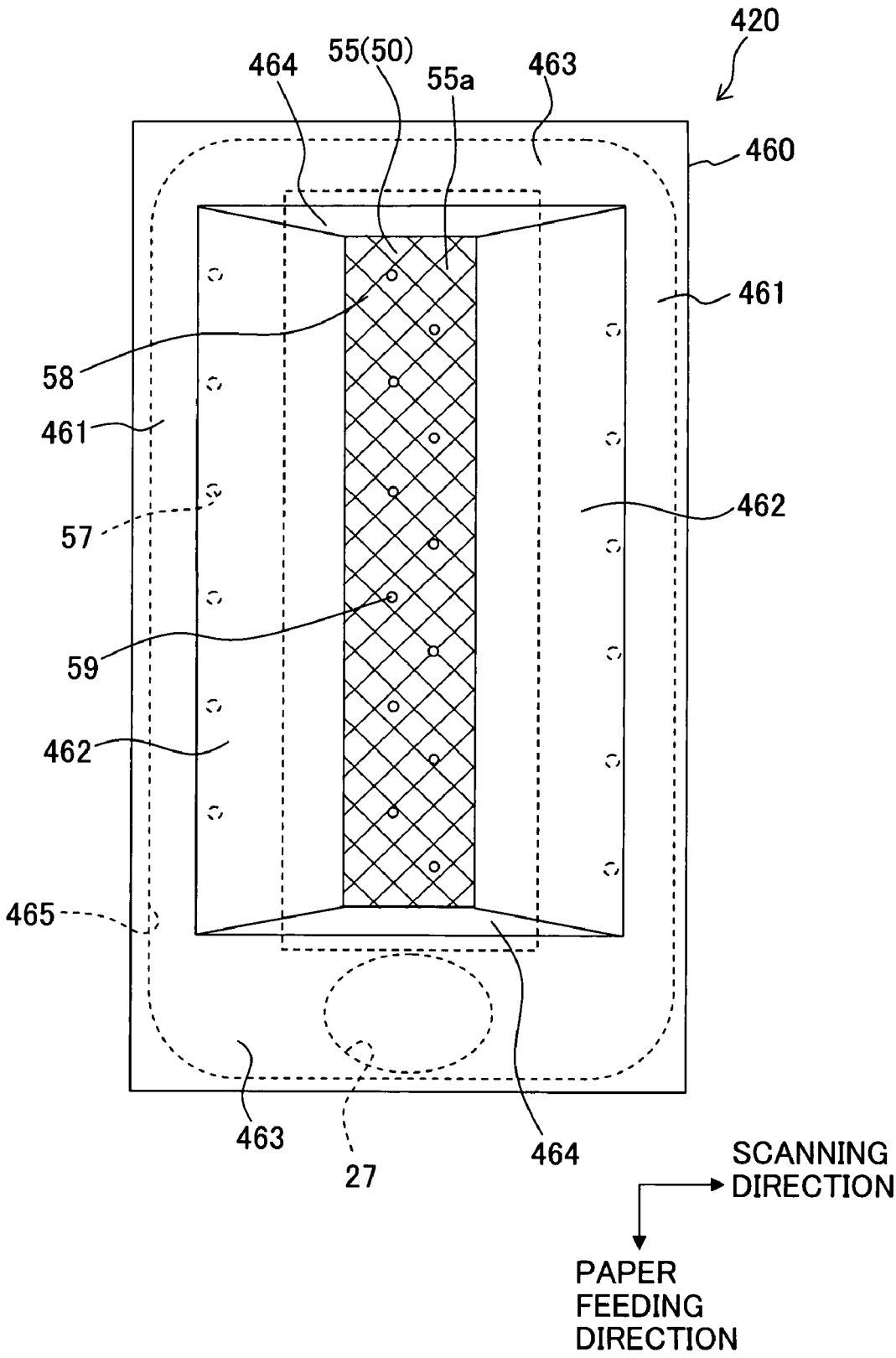
FIG. 10 is a bottom view of an ink-jet head according to a third embodiment of the present invention.

Next, with reference to FIG. 10, a third embodiment of the present invention will be explained. FIG. 10 is a bottom view of an ink-jet head of this embodiment. The ink-jet head 420 of this embodiment is similar to the first embodiment except the shape of a manifold block 460. Main differences between the manifold block 460 of this embodiment and the manifold block 60 of the first embodiment are that the manifold block 60 is a member having a planar shape in a substantially U shape as the whole and has the inclined surfaces 62, 64 formed in a substantially U shape, whereas the manifold block 460 of this embodiment is a member having a planar shape in a substantially shape as the whole, and has inclined surfaces 462, 464 which are formed in a ring shape. Note that in the following explanation, components having same structures as those in the first embodiment are designated the same reference numerals, and explanations thereof are omitted accordingly.

As shown in FIG. 10, the manifold block 460 has two extended portions 461 which are separated from each other and adjacent to each other in the scanning direction and extend in the paper feeding direction, and two coupling portions 463 coupling both end portions of the two extended portions 461, and has a planar shape in a substantially O shape as the whole. A contour of the manifold block 46 in a plan view substantially matches with those of the pressure generating block 50 and the nozzle plate 55. Then, the manifold block 460 is adhered to the ink jetting surface 55*a* of the nozzle plate 55 so as not to block the nozzles 59, namely, so as to surround the nozzle rows completely. At this time, the two extended portions 461 of the manifold block 460 extend in parallel to each other with the nozzle rows intervening therebetween. Inside the manifold block 460, a manifold 465 in a substantially O shape is formed.

Further, the two extended portions 461 and the two coupling portions 463 have inclined surfaces 462, 464 respectively, which incline toward the ink jetting surface 55*a*. The inclined surfaces 462 formed respectively on the two extended portions 461 extend in the paper feeding direction, and are continuous to the ink jetting surface 55*a* via end portions thereof on sides near the rows of the nozzles 59. Also, the inclined surfaces 464 formed on the two coupling portions 463 couple respectively both end portions of the inclined surfaces 462 formed on the two extended portions 461, and are continuous to the ink jetting surface 55*a* via end portions thereof on sides near the rows of the nozzles 59. Specifically, the inclined surfaces 462, 464 are formed in a substantially O shape, namely in a ring shape on the periphery of the rows of the nozzles 59. Then, the inclined surfaces 462 incline such that the farther a certain point thereon from the rows of the nozzles 59 in the scanning direction, the farther the certain point from the nozzle plate 55 in a height direction (direction perpendicular to the ink jetting surface 55*a*). Note that degrees of inclination of the inclined surfaces 462 are the same as those of the inclined surfaces 62 of the first embodiment.

As above, the ink-jet head 420 of this embodiment can wipe off ink adhering to the ink jetting surface 55*a* with the wiper 80, similarly to the ink-jet head 20 of the first embodiment.

Also, in the ink-jet head 420 of this embodiment, since the manifold block 460 having the inclined surfaces 462, 464 formed in a ring shape on the periphery of the nozzle rows is joined to the ink jetting surface 55*a*, it is possible to more securely prevent the recording paper 90 from contacting the ink jetting surface 55*a*. Therefore, damage to the liquid-repellent film 58 formed on the ink jetting surface 55*a* can be prevented. Thus, it is possible to prevent occurrence of dispersion in ink jetting property due to damage to the liquid-repellent film 58 in the vicinity of the nozzles 59.

As above, the preferred embodiments of the present invention have been described, but the present invention is not limited to the above-described embodiments and can be changed in design in various ways within the range described in the claims. For example, in the first to third embodiments, the case where the manifold block 60 (160, 260, 360, 460) is joined to the ink jetting surface 55*a* of the nozzle plate 55 is explained, but the present invention is not limited thus. A spacer may be provided between the nozzle plate 55 and the manifold block 60 (160, 260, 360, 460).

Also, in the above-described first to third embodiments, the case where the manifold block 60 (160, 260, 360, 460) is produced by injection molding of resin is explained, but the present invention is not limited thus. The material of the manifold block 60 (160, 260, 360, 460) may be any material that can be injection molded, such as a mixture of metal powder and resin for example. Further, the manifold block 60 (160, 260, 360, 460) may be produced for example by joining a plurality of members for example, not by injection molding. In this case, a material thereof may be a material which cannot be injection molded.

Also, in the above-described second embodiment (see FIGS. 6, 7), there is explained the case where the transporting structure which transports the ink adhering to the ink jetting surface 55*a* in the direction to depart from the nozzles 59 is the grooves 166. Also, in the first modification (see FIG. 8) of the second embodiment, the case where the transporting structure is the transport surface 266 is explained, and in the second modification (see FIG. 9), the case where the transporting structure is the high liquid-repellent areas 366 and the low liquid-repellent areas 367 is explained, but the construction of the transporting structure is not limited thereto.

For example, in the first modification of the second embodiment, there is explained the case where the transport surface 266 as the transporting structure is constituted of a plurality of areas adjacent to each other in the scanning direction, and as an area is located further away from the nozzles 59, the liquid repellency thereof is further decreased or lowered as compared to a liquid repellency of another area located in the end portion on the side continuous to the ink jetting face 55*a*. However, the transport surface 266 may be formed of a liquid-repellent film having a liquid repellency which changes sequentially in the scanning direction.

Further, for example, in the second modification of the second embodiment, there is explained the case where the high liquid-repellent areas 366 and the low liquid-repellent areas 367 as the transporting structure are both patterned in a zigzag form, but the present invention is not limited thus. The end portions of the high liquid-repellent areas 366 which are farthest (the most away) from the nozzles 59 and the end portions of the low liquid-repellent areas 367 on the side of the ink jetting surface 55*a* may not necessarily be the pointed end. Also, for example, on the inclined surfaces 362, a plurality of high liquid-repellent areas 366 each in a dot shape may be formed so that the density thereof becomes lower from the end portion on the side of the ink jetting surface 55*a* in a direction to separate away from the nozzles 59, and an area other than the high liquid-repellent areas 366 of the inclined surfaces 362 may be a low liquid-repellent area 367.

Additionally, in the above-described first and second embodiments, there is explained the case where the inclined surfaces 62 (162, 262, 362), 64 in a substantially U shape are formed on the periphery of the rows of the nozzles 59, and in the third embodiment, there is explained the case where the ring-shape inclined surfaces 462, 464 in a substantially O shape are formed on the periphery of the rows of the nozzles 59, but the inclined surfaces are not limited thus. It is satisfactory when the inclined surfaces 62 (162, 262, 362, 462), 64, 462, 464 are formed at least on one side of the nozzle rows with respect to the scanning direction.

Also, the above-described first to third embodiments are explained with respect to the serial-type ink-jet head 20 (120, 220, 320, 420) which jets ink on the recording paper 90 while moving in the scanning direction, but the present invention may also be applied to a line-type ink-jet head which is arranged fixedly in a direction orthogonal to the transporting direction of the recording paper 90. In this case, it is also possible to omit the fixed-type wiper.

What is claimed is:

1. A liquid-droplet jetting head which jets a droplet of a liquid, comprising:

a first block having a plurality of pressure chambers and a pressure applying mechanism which applies pressure variation to the liquid in the pressure chambers;

a nozzle plate which is joined to the first block and in which a plurality of nozzles communicating with the pressure chambers respectively are formed; and a second block which is arranged on a side of the nozzle plate opposite to the first block and in which a manifold is formed, the manifold retaining the liquid to be supplied to each of the pressure chambers;

wherein the nozzle plate has a plurality of communication holes each of which communicates the manifold and one of the pressure chambers; and wherein the second block has an inclined surface which is inclined toward a surface of the nozzle plate and is continuous to the surface of the nozzle plate at one end of the inclined surface.

2. The liquid-droplet jetting head according to claim 1;

wherein the inclined surface includes a transporting structure which transports the liquid adhering to the surface of the nozzle plate in an away direction separating away from the nozzles.

3. The liquid-droplet jetting head according to claim 2;

wherein the transporting structure is a groove extending from the one end of the inclined surface in the away direction away from the nozzles.

4. The liquid-droplet jetting head according to claim 2;

wherein the transporting structure is a transport surface having, at the one end of the inclined surface, a liquid repellency not more than a liquid repellency of the surface of the nozzle plate; and wherein the liquid repellency of the transport surface is decreased in the away direction from the one end toward the other end of the inclined surface.

5. The liquid-droplet jetting head according to claim 2;

wherein the transporting structure has a first area having a liquid repellency not more than a liquid repellency of the surface of the nozzle plate and a second area having a liquid repellency lower than the liquid repellency of the first area; and wherein the first and second areas are patterned to move the liquid adhering to the surface of the nozzle plate in the away direction from the one end to the other end.

6. The liquid-droplet jetting head according to claim 5;

wherein the first and second areas both extend in the away direction from the one end to the other end, the first area has a width which is decreased from a side of the one end toward a side of the other end, and the second area has a width which is increased from the side of the one end toward the side of the other end.

7. The liquid-droplet jetting head according to claim 6;

wherein the side of the other end of the first area is a pointed end, and the side of the one end of the second area is a pointed end.

8. The liquid-droplet jetting head according to claim 1;

wherein the second block is produced by injection molding.

9. The liquid-droplet jetting head according to claim 1;

wherein the second block is formed of resin.

10. The liquid-droplet jetting head according to claim 1;

wherein the inclined surface is formed so that a distance from the surface of the nozzle plate is increased at positions separated away further from in a predetermined direction in which the liquid-droplet jetting head is moved.

11. The liquid-droplet jetting head according to claim 1;

wherein the inclined surface has a planar shape.

12. The liquid-droplet jetting head according to claim 1;

wherein the inclined surface includes a first inclined surface and a second inclined surface.

13. The liquid-droplet jetting head according to claim 12;

wherein one end of the first inclined surface is continuous to the surface of the nozzle plate and the other end of the first inclined surface is connected to one end of the second inclined surface; and wherein the other end of the second inclined surface is continuous to the surface of the nozzle plate.

14. The liquid-droplet jetting head according to claim 1;

wherein the inclined surface is provided on the surface of the nozzle plate as a pair of inclined surfaces arranged on both sides of the nozzles.

15. The liquid-droplet jetting head according to claim 1;

wherein the liquid-droplet jetting head is an ink-jet head.

16. A liquid-droplet jetting apparatus which jets a droplet of a liquid, comprising:

a liquid-droplet jetting head including:

a first block having a plurality of pressure chambers and a pressure applying mechanism which applies pressure variation to the liquid in the pressure chambers;

a nozzle plate which is joined to the first block, and in which a plurality of nozzles communicating with the pressure chambers respectively are formed; and a second block which is arranged on a side of the nozzle plate opposite to the first block and in which a manifold is formed, the manifold retaining the liquid to be supplied to each of the pressure chambers, and which has an inclined surface inclining toward a surface of the nozzle plate and being continuous to the surface of the nozzle plate at one end of the inclined surface, the nozzle plate having a plurality of communication holes each of which communicates the manifold and one of the pressure chambers;

a moving section which reciprocates the liquid-droplet jetting head in a predetermined direction;

a medium-transporting section which transports a jetting-objective medium, on which the liquid droplet jetted from the liquid-droplet jetting head is to be landed, in an orthogonal direction orthogonal to the predetermined direction; and a wiper which wipes the nozzles;

wherein the nozzles form a nozzle row arranged in the orthogonal direction; and wherein the inclined surface is located at least on one side of the nozzle row with respect to the predetermined direction.

17. The liquid-droplet jetting apparatus according to claim 16;

wherein the predetermined direction is a scanning direction.

18. The liquid-droplet jetting apparatus according to claim 16;

wherein the inclined surface is formed to be annular in a periphery of the nozzle row.

19. The liquid-droplet jetting apparatus according to claim 16;

wherein the liquid-droplet jetting apparatus is an ink-jet printer.

* * * * *